US012691339B2

(12) United States Patent
Shimahara

(10) Patent No.: US 12,691,339 B2
(45) Date of Patent: Jul. 28, 2026

(54) GOLF CLUB HEAD

(71) Applicant: Sumitomo Rubber Industries, Ltd., Hyogo (JP)

(72) Inventor: Yuki Shimahara, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 111 days.

(21) Appl. No.: 18/347,409

(22) Filed: Jul. 5, 2023

(65) Prior Publication Data

US 2024/0009523 A1 Jan. 11, 2024

(30) Foreign Application Priority Data

Jul. 7, 2022 (JP) ..... 2022-109812

(51) Int. Cl.
*A63B 53/04* (2015.01)

(52) U.S. Cl.
CPC ..... *A63B 53/0433* (2020.08); *A63B 53/0408* (2020.08); *A63B 53/0445* (2020.08); *A63B 53/047* (2013.01)

(58) Field of Classification Search
CPC ..... A63B 53/0433; A63B 53/047; A63B 2053/0479; A63B 2053/0483
See application file for complete search history.

(56) References Cited

U.S. PATENT DOCUMENTS 1,505,296 A * 8/1924 Smith ..... A63B 53/047 473/328
1,541,126 A * 6/1925 Dunn ..... A63B 53/0466 473/328
D94,550 S * 2/1935 Jansky ..... D21/752
3,810,631 A * 5/1974 Braly ..... A63B 53/047 473/328
3,897,065 A * 7/1975 Solheim ..... A63B 53/04 473/349
4,322,083 A * 3/1982 Imai ..... A63B 53/0466 473/344
4,850,593 A * 7/1989 Nelson ..... A63B 53/0466 473/328
5,046,733 A * 9/1991 Antonious ..... A63B 53/047 473/287

(Continued)

FOREIGN PATENT DOCUMENTS

JP S53-094762 U 8/1978
JP 07031696 A * 2/1995

(Continued)

*Primary Examiner* — Alvin A Hunter

(74) *Attorney, Agent, or Firm* — Studebaker Brackett PLLC

(57) ABSTRACT

An iron type golf club head includes a hitting face including a plurality of score lines, a sole surface, a leading edge that constitutes a front edge of the sole surface, a trailing edge that constitutes a rear edge of the sole surface, and a score line center position that is determined based on the score lines. The sole surface includes a ridgeline that extends from a toe side to a heel side, and an additional surface that extends to traverse the ridgeline. The additional surface is a flat surface or a recessed surface. The additional surface may include a heel part that is located on the heel side with respect to the score line center position, and a toe part that is located on the toe side with respect to the score line center position.

15 Claims, 12 Drawing Sheets

(56) References Cited

U.S. PATENT DOCUMENTS 5,301,944 A * 4/1994 Koehler ..... A63B 53/04 473/328
5,330,187 A * 7/1994 Schmidt ..... A63B 60/00 473/291
5,377,983 A * 1/1995 Fenton ..... A63B 53/047 473/328
5,419,556 A * 5/1995 Take ..... A63B 53/04 473/328
5,603,668 A * 2/1997 Antonious ..... A63B 60/00 473/328
5,643,106 A * 7/1997 Baird ..... A63B 53/047 473/328
5,716,288 A * 2/1998 Sacco ..... A63B 53/047 473/290
5,800,281 A * 9/1998 Gilbert ..... A63B 53/04 473/328
5,971,866 A * 10/1999 Adams ..... A63B 53/047 473/328
6,106,410 A * 8/2000 Glod ..... A63B 53/04 473/328
6,251,029 B1 * 6/2001 Roberts ..... A63B 53/04 473/328
6,454,663 B1 * 9/2002 Bakke ..... A63B 60/00 473/328
6,471,601 B1 * 10/2002 McCabe ..... A63B 53/047 473/328
7,393,286 B1 * 7/2008 Renegar ..... A63B 53/047 473/328
7,442,130 B2 * 10/2008 Ban ..... A63B 53/00 473/328
7,517,286 B2 * 4/2009 Nagai ..... A63B 60/52 473/409
8,083,607 B2 * 12/2011 Clausen ..... A63B 53/04 473/291
8,734,270 B2 * 5/2014 Harrington ..... A63B 53/04 473/328
9,227,114 B2 * 1/2016 Takechi ..... A63B 53/047
9,878,219 B2 * 1/2018 Shimahara ..... A63B 53/047
9,956,461 B2 * 5/2018 Shimahara ..... A63B 53/047
10,099,092 B2 * 10/2018 Morin ..... A63B 60/00
10,105,580 B2 * 10/2018 Shimahara ..... A63B 53/047
10,661,129 B2 * 5/2020 Seagram ..... A63B 60/00
10,744,377 B1 * 8/2020 Chuang ..... A63B 53/0433
11,004,046 B2 * 5/2021 Long ..... G06Q 20/00
11,266,884 B2 * 3/2022 Shimahara ..... A63B 53/00
12,036,448 B2 * 7/2024 Takehara ..... A63B 53/08
2016/0199704 A1 * 7/2016 Shimahara ..... A63B 53/00 473/290

FOREIGN PATENT DOCUMENTS

JP 07299164 A * 11/1995 ..... A63B 53/047
JP 08257179 A * 10/1996 ..... A63B 53/04
JP 2000279563 A * 10/2000 ..... A63B 53/04
JP 2001252380 A * 9/2001 ..... A63B 53/047
JP 2007175119 A * 7/2007 ..... A63B 53/047
JP 2008-035984 A 2/2008
JP 2013059614 A * 4/2013 ..... A63B 53/04
JP 2015047305 A * 3/2015 ..... A63B 53/00
JP 2015-186514 A 10/2015
JP 2017158920 A * 9/2017 ..... A63B 53/005
JP 2017158927 A * 9/2017 ..... A63B 53/005

* cited by examiner

GOLF CLUB HEAD

CROSS REFERENCE TO RELATED APPLICATION

The present application claims priority to Japanese Patent Application No. 2022-109812 filed on Jul. 7, 2022. The entire contents of this Japanese Patent Application are hereby incorporated by reference.

BACKGROUND

Technical Field

The present disclosure relates to golf club heads.

Description of the Related Art

There has been proposed an iron type golf club head that includes a sole having a characteristic shape. JP2015-186514A discloses a golf club head that includes a face on which score lines are formed, and a sole on which a recess is formed. The recess is formed only on the toe side with respect to the center of the score lines in their longitudinal direction. Alternatively, the recess is formed such that a length of its toe side part located on the toe side with respect to the center of the score lines in the longitudinal direction is longer than a length of its heel side part located on the heel side with respect to the center of the score lines in the longitudinal direction. This head is less likely to cause a rotation of the head in a direction in which the face is closed.

SUMMARY

The inventor of the present disclosure has found that a novel shape of a sole stabilizes contact between a head and a ball, exhibits smooth pass-through performance, and also achieves other advantageous effects. It is an object of the present disclosure to provide an iron type golf club head including a sole that exhibits excellent performance with its novel shape.

In one aspect, an iron type golf club head includes a hitting face including a plurality of score lines, a sole surface, a leading edge that constitutes a front edge of the sole surface, a trailing edge that constitutes a rear edge of the sole surface, and a score line center position that is determined based on the score lines. The sole surface includes a ridgeline that extends from a toe side to a heel side, and an additional surface that is a flat surface or a recessed surface and extends to traverse the ridgeline.

DESCRIPTION OF THE PREFERRED EMBODIMENTS

Hereinafter, embodiments will be described in detail with appropriate references to the accompanying drawings.

The following terms are defined in the present disclosure.

[Reference State]

Figure 12:
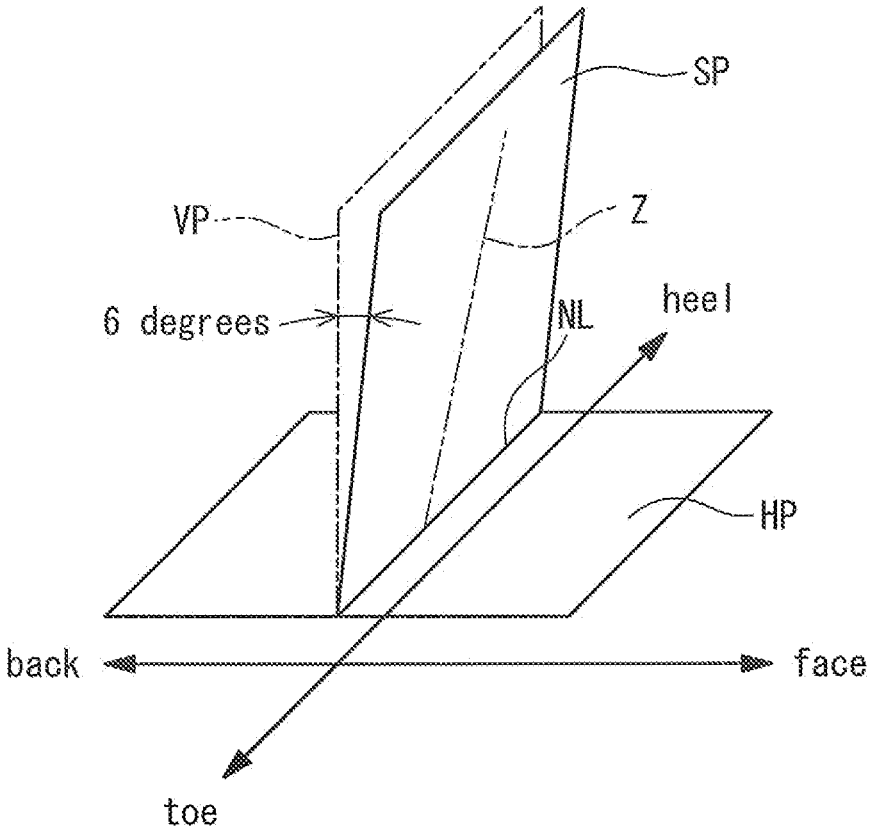
FIG. 12 is a conceptual diagram for illustrating a reference state.

The reference state is a state where a head is placed on a ground plane HP in a state where score lines and the ground plane HP are parallel to each other. When a head is in the reference state, a center axis line Z (a shaft axis line) of a shaft hole of the head lies on (is contained in) an inclined reference surface SP that is inclined by 6 degrees with respect to a perpendicular plane VP (see FIG. 12). The perpendicular plane VP is a plane perpendicular to the ground plane HP. An angle between the inclined reference surface SP and the perpendicular plane VP is 6 degrees, and the inclined reference surface SP is inclined by 6 degrees toward a face side (frontward) with respect to the perpendicular plane VP. When a head is in the reference state, score lines are parallel to the ground plane HP and parallel to the inclined reference surface SP. The reference state corresponds to a posture of a head when a golfer addresses a ball with the head in such a manner that his hands precede the head by 6 degrees.

[Toe-Heel Direction]

In a head which is in the reference state, the direction of an intersection line between the inclined reference surface SP and the ground plane HP is the toe-heel direction. The toe-heel direction is parallel to the score lines.

[Face-Back Direction]

The face-back direction is a direction that is perpendicular to the toe-heel direction and parallel to the ground plane HP. The face-back direction is also referred to as a front-rear direction. The face side is also referred to as front side. The back side is also referred to as rear side.

[Up-Down Direction]

The up-down direction is a direction that is perpendicular to the toe-heel direction and is perpendicular to the face-back direction.

[Toe Reference Position]

Figure 1:
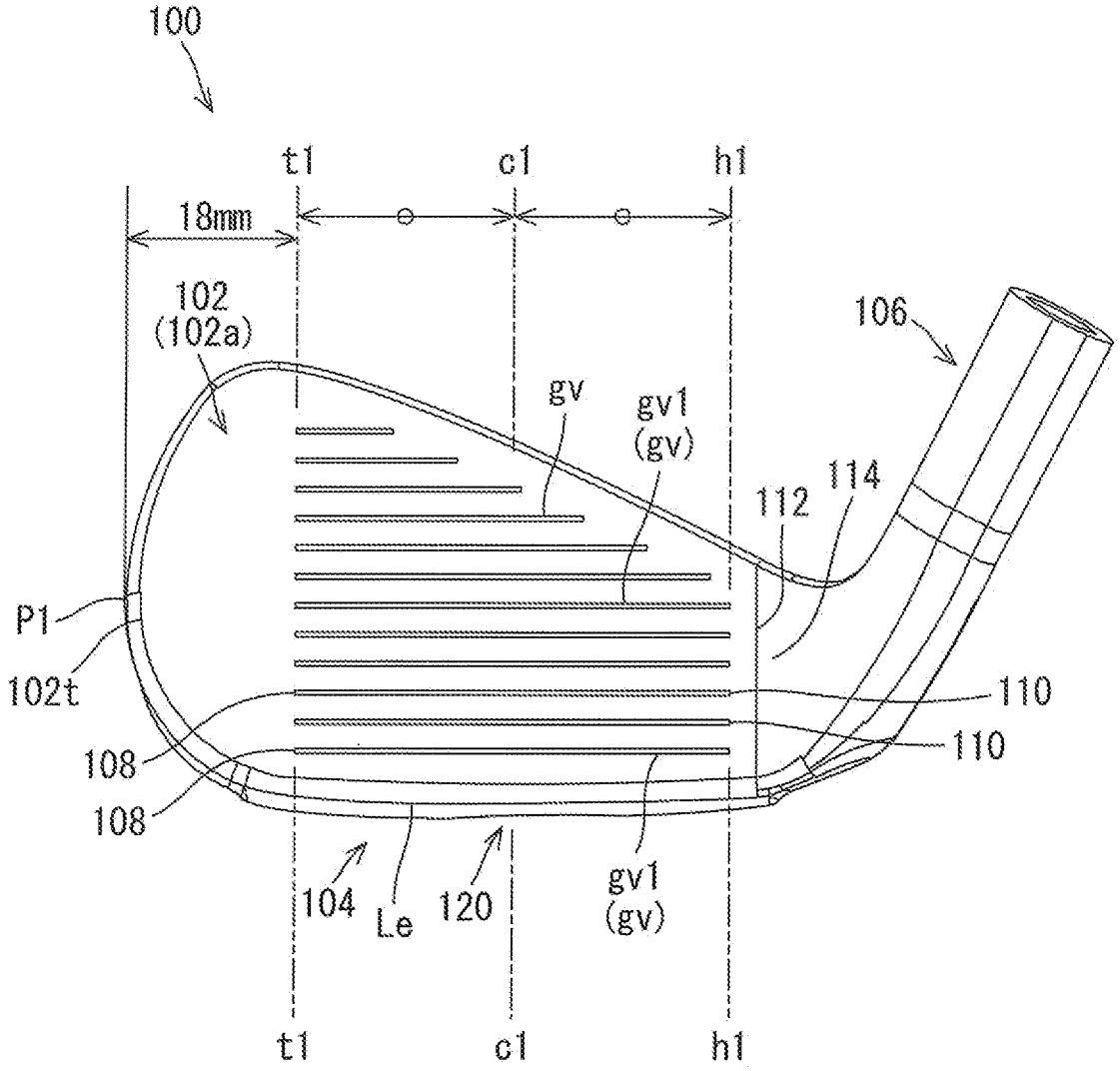
FIG. 1 is a front view of a golf club head according to a first embodiment.

A position that is spaced 18 mm apart from the toe-most point of a head toward the heel side is defined as the toe reference position (see FIG. 1). In general iron type golf club heads, the positions of toe-side ends of the score lines coincide with the toe reference position. The toe reference position is a position in the toe-heel direction.

[Heel Reference Position]

The score lines have respective heel-side ends. A heel-most position of the heel-side ends is the heel reference position. In general iron type golf club heads, the position of the heel-side end of a longest score line coincides with the heel reference position. The heel reference position is a position in the toe-heel direction.

[Score Line Center Position]

A position that divides a distance between the toe reference position and the heel reference position into two equal parts is defined as the score line center position. In general iron type golf club heads, the center position of the longest score line coincides with the score line center position. The score line center position is a position in the toe-heel direction.

[Leading Edge]

In a cross section of a head taken in the face-back direction, a point located at the front-most position is determined. This point is determined in each of cross sections taken at different positions in the toe-heel direction. A set of the points is defined as the leading edge. The leading edge is the front edge of a sole surface.

[Trailing Edge]

The trailing edge is the rear edge of a sole surface. When a radius of curvature of the sole surface is sequentially measured rearward in a cross section of a head taken in the face-back direction, a point at which the radius of curvature becomes first less than or equal to 5 mm is determined. A set of the points is defined as the trailing edge.

[Planar View]

A bottom view of a head as viewed from the sole side is also referred to as a planar view. That is, the planar view means a projected figure obtained by projecting the sole surface of a head which is in the reference state onto a plane parallel to the ground plane HP. The projected figure is obtained by vertical projection. Bottom views of heads as viewed from the sole side such as FIG. 2 and FIG. 7 described below are the planar views.

Note that for determining a radius of curvature of a point on a cross-sectional contour line in the present disclosure, the following three points on the cross-sectional contour line are specified: a point to be measured (hereinafter referred to as measurement point), a point located 0.5 mm apart from the measurement point toward one side, and a point located 0.5 mm apart from the measurement point toward the other side. A radius of a circle that passes through these three points is defined as the radius of curvature at the measurement point. "0.5 mm" for these points is a route length measured along the cross-sectional contour line. This "0.5 mm" is a sufficiently small distance for evaluating the radius of curvature at a measurement point. By setting two points located 0.5 mm apart from the measurement point, the radius of curvature at each point on a free-form curve can be determined without the need to solve the differential equation of a cross-sectional contour line. This method for determining a radius of curvature is also referred to as 0.5 mm method.

The unit of angles in the present disclosure is degree.

Figure 2:
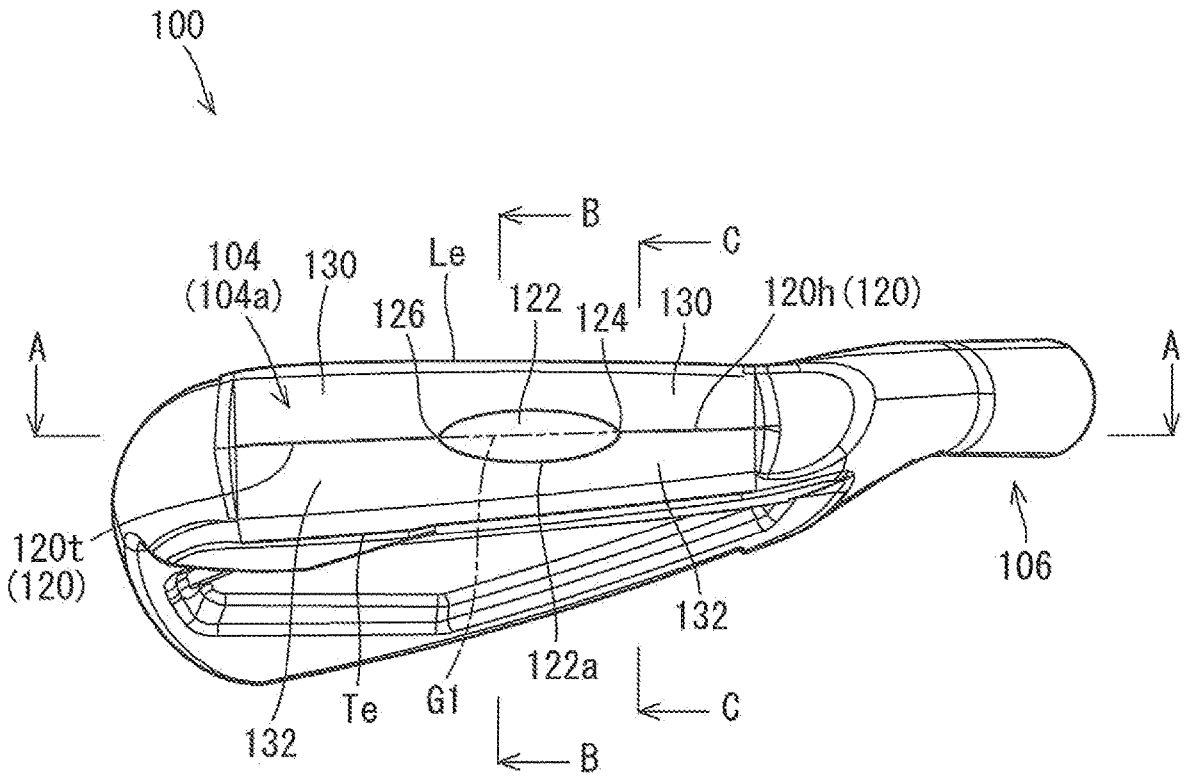
FIG. 2 is a bottom view of the golf club head in FIG. 1.
Figure 3:
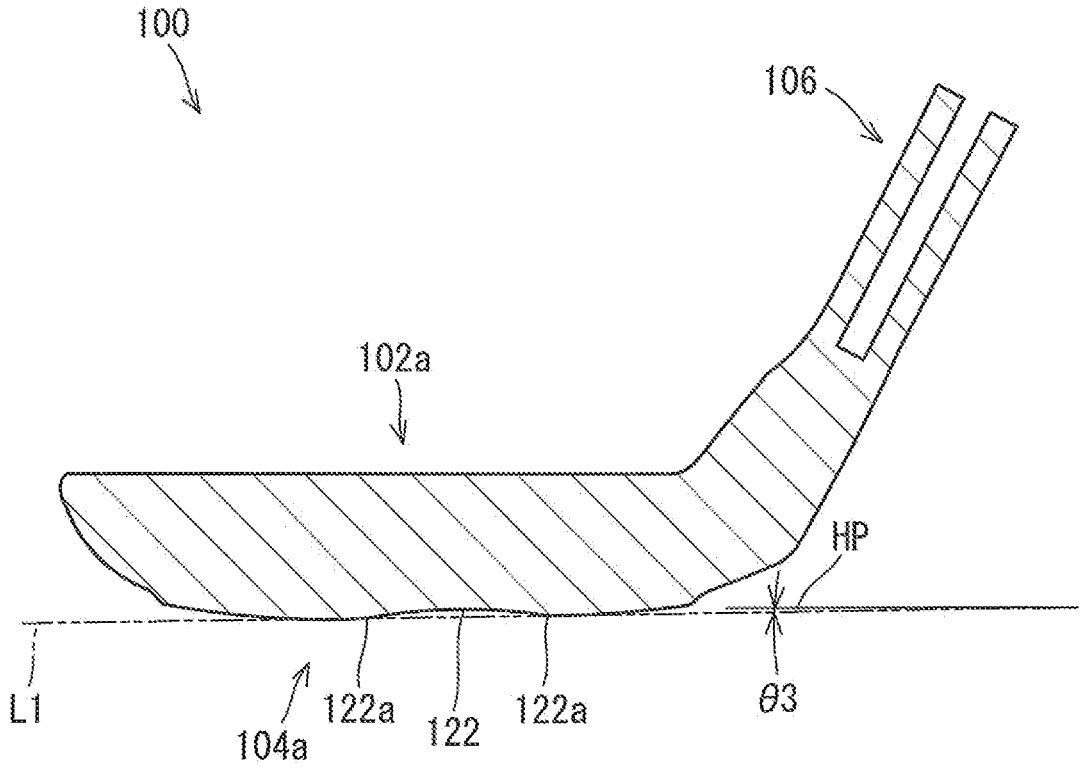
FIG. 3 is a cross-sectional view taken along line A-A in FIG. 2.
Figure 4:
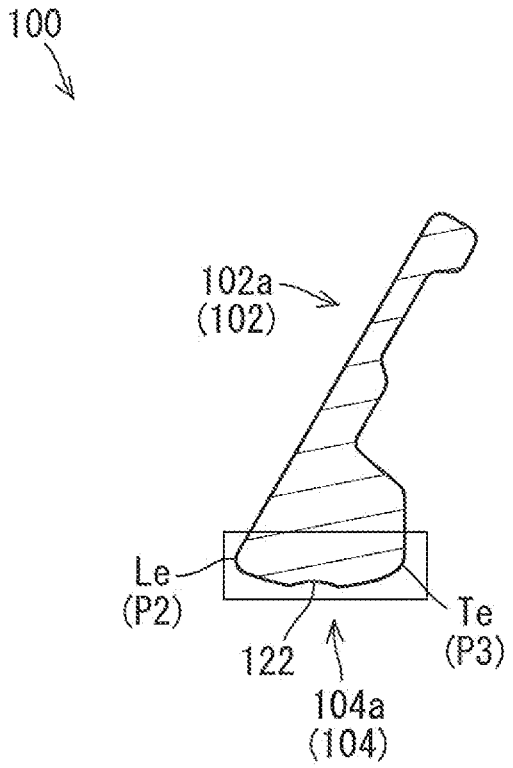
FIG. 4 is a cross-sectional view taken along line B-B in FIG. 2.
Figure 5A:
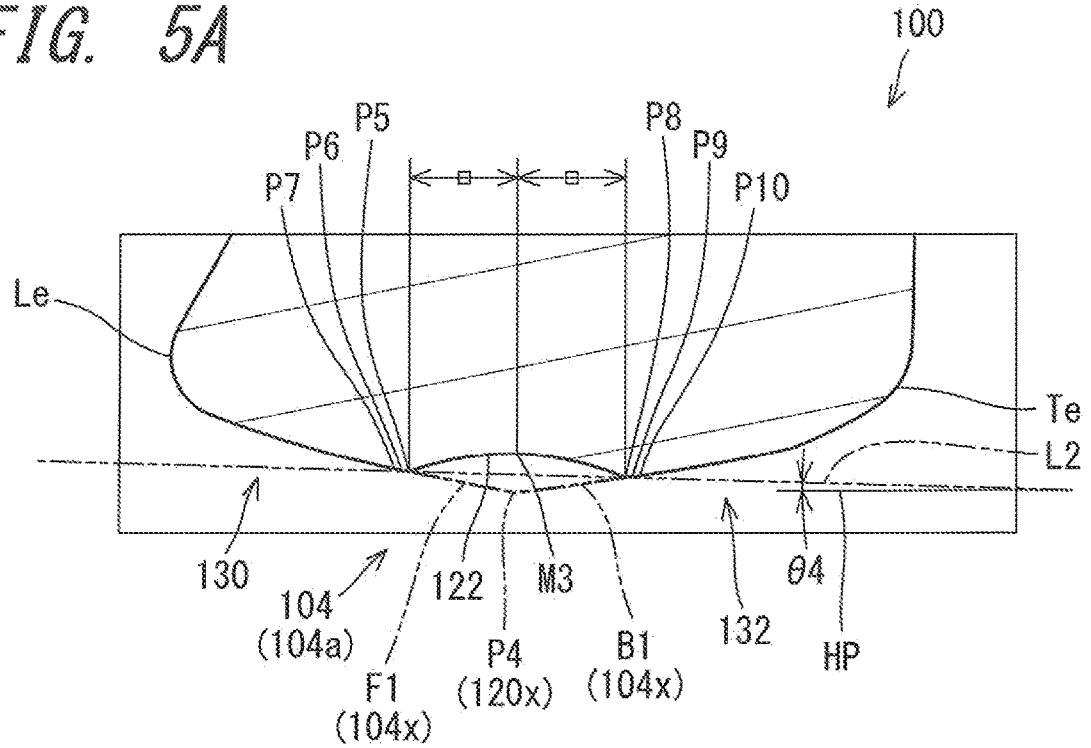
FIG. 5A is an enlarged view of a portion surrounded by a rectangle in FIG. 4.

FIG. 1 is a front view of a head 100 according to a first embodiment as viewed from the face side. FIG. 2 is a bottom view of the head 100 as viewed from the sole side. FIG. 3 is a cross-sectional view taken along line A-A in FIG. 2. FIG. 4 is a cross-sectional view taken along line B-B in FIG. 2. FIG. 5A is an enlarged cross-sectional view of a portion surrounded by a rectangle in FIG. 4. FIG. is a fragmentary enlarged view of a cross section taken along line C-C in FIG. 2. Note that, in the cross-sectional views of FIG. 4, FIG. 5A and FIG. 5B, score lines gv are omitted.

The head 100 is an iron type golf club head. There is no limitation on the club number of the head 100.

The head 100 includes a face portion 102, a sole portion 104, and a hosel portion 106. The head 100 has a cavity back construction.

The face portion 102 includes a hitting face 102*a*. The hitting face 102*a* is also referred to as a face surface. The hitting face 102*a* is a flat surface. When a golfer hits a golf ball with the head 100, the hitting face 102*a* comes into contact with the ball. A plurality of score lines gv are formed on the hitting face 102*a*. The score lines gv are arranged at regular intervals. All of the score lines gv are parallel to each other. The score lines gv include a longest score line gv1. A plurality of longest score lines gv1 are formed. The score lines gv contribute to increase and stability in backspin rate.

Each score line gv has a toe-side end 108. The positions in the toe-heel direction of the toe-side ends 108 of all the score lines gv coincide with each other.

Note that the score lines gv may be formed on almost the entirety of the hitting face 102*a*. In such a head, each score line gv extends to reach the vicinity of the outer edge of the hitting face 102*a*. For this reason, the toe-side ends 108 are located in the vicinity of a toe-side edge 102*t* of the hitting face 102*a*. In this arrangement, the positions of the toe-side ends 108 in the toe-heel direction do not coincide with each other. Such a configuration is mainly adopted in wedges, and such wedges are referred to as full score line wedges. Except a head having such full score lines, the position of the toe-side ends of the score lines can be the toe reference position.

At least one score line gv has a heel-most end 110. In the present embodiment, the heel-most end 110 is the heel-side end of each longest score line gv1. The heel-most end 110 is positioned in the vicinity of a heel-side edge 112 of the hitting face 102*a*. The edge 112 is a boundary between the hitting face 102*a* which is a flat surface and a non-flat portion 114 that is connected to the hosel portion 106. The positions of the ends 110 in the toe-heel direction coincide with each other.

As described above, the toe reference position and the heel reference position are defined in the head 100. As shown in FIG. 1, the head 100 has a toe-most point P1. A position that is spaced 18 mm apart from the point P1 toward the heel side is the toe reference position t1. The toe reference position t1 is a position in the toe-heel direction. In the present embodiment, the position of the toe-side ends 108 of the score lines gv is the toe reference position t1. The position of the heel-most end 110 among the heel-side ends of the score lines gv is the heel reference position h1. The heel reference position h1 is a position in the toe-heel direction. In the present embodiment, the positions of the heel-side ends of the longest score lines coincide with the heel reference position h1.

As described above, the score line center position is defined in the head 100. As shown in FIG. 1, a position that divides a distance between the toe reference position t1 and the heel reference position h1 into two equal parts is the score line center position c1. The score line center position c1 is a position in the toe-heel direction.

As shown in FIG. 2, the sole portion 104 has a sole surface 104*a*. The sole surface 104*a* is the surface of the sole portion 104.

The sole surface 104*a* includes a ridgeline 120 and an additional surface 122. The ridgeline 120 is a viewable line. In a cross section taken along the face-back direction, the ridgeline 120 constitutes a corner. In a cross section taken along the face-back direction, the radius of curvature of the ridgeline 120 can be less than or equal to 5 mm. As described above, the radius of curvature is measured by the 0.5 mm method. The ridgeline 120 extends from the toe side to the heel side.

In the planar view, the additional surface 122 is a region having an elliptical shape. The additional surface 122 is a recessed surface. The additional surface 122 extends to traverse the ridgeline 120. The width of the additional surface 122 in the toe-heel direction is greater than the width of the additional surface 122 in the face-back direction. The additional surface 122 is provided at a position that includes the score line center position c1. The entirety of the additional surface 122 is positioned on the toe side with respect to the heel reference position h1. The entirety of the additional surface 122 is positioned on the heel side with respect to the toe reference position t1. There is no limitation on the shape of the additional surface 122 in the planar view.

The additional surface 122 is located apart from the leading edge Le. The additional surface 122 does not reach the leading edge Le. The entirety of the additional surface 122 is positioned on the back side with respect to the leading edge Le. The additional surface 122 is located apart from the trailing edge Te. The additional surface 122 does not reach the trailing edge Te. The entirety of the additional surface 122 is positioned on the face side with respect to the trailing edge Te.

The ridgeline 120 has a gap in a region in which the additional surface 122 is present. The ridgeline 120 is constituted by a heel ridgeline 120*h* that is located on the heel side with respect to the additional surface 122, and a toe ridgeline 120*t* that is located on the toe side with respect to the additional surface 122. The entirety of the toe ridgeline 120*t* is located on the toe side with respect to the score line center position c1. The entirety of the heel ridgeline 120*h* is located on the heel side with respect to the score line center position c1. The toe ridgeline 120*t* is longer than the heel ridgeline 120*h*.

The heel ridgeline 120*h* has a toe-side end point 124. The toe ridgeline 120*t* has a heel-side end point 126. In the planar view, a line segment G1 that connects the end point 124 and the end point 126 intersects the additional surface 122. That is, the line segment G1 divides the additional surface 122 into two regions in the planar view. The line segment G1 is indicated by a two-dot chain line in FIG. 2.

The toe-side end point 124 of the heel ridgeline 120*h* is positioned on an outer edge line 122*a* of the additional surface 122. The end point 124 does not have to be positioned on the outer edge line 122*a*. That is, the end point 124 may be positioned apart from the additional surface 122. From the viewpoint of enhancing advantageous effects brought by the ridgeline 120, the ridgeline 120 is preferably long. From this viewpoint, the distance between the outer edge line 122*a* and the end point 124 is preferably less than or equal to 5 mm, more preferably less than or equal to 3 mm, and still more preferably less than or equal to 1 mm. This distance is measured in the toe-heel direction. This distance is yet more preferably 0 mm as in the present embodiment. The heel ridgeline 120*h* extends to reach a position located on the heel side with respect to the heel reference position h1.

The heel-side end point 126 of the toe ridgeline 120*t* is positioned on the outer edge line 122*a* of the additional surface 122. The end point 126 does not have to be positioned on the outer edge line 122*a*. That is, the end point 126 may be positioned apart from the additional surface 122. From the viewpoint of making the ridgeline 120 longer, the distance between the outer edge line 122*a* and the end point 126 is preferably less than or equal to 5 mm, more preferably less than or equal to 3 mm, and still more preferably less than or equal to 1 mm. This distance is measured in the toe-heel direction. This distance is yet more preferably 0 mm as in the present embodiment. The toe ridgeline 120*t* extends to reach a position located on the toe side with respect to the toe reference position t1.

The head 100 includes the leading edge Le. As shown in FIG. 4, in a cross section of the head 100 taken in the face-back direction, a point P2 located at the front-most position is determined. This point P2 is determined in each of cross sections taken at different positions in the toe-heel direction. A set of the points P2 is defined as the leading edge Le. The leading edge Le constitutes a part of the contour line of the sole surface 104*a*. The leading edge Le is the front edge of the sole surface 104*a*.

The head 100 includes the trailing edge Te. As shown in FIG. 4, when the radius of curvature of the sole surface 104*a* is sequentially measured rearward in a cross section of the head 100 taken in the face-back direction, a point P3 at which the radius of curvature becomes first less than or equal to 5 mm is determined. A set of the points P3 is defined as the trailing edge Te. The trailing edge Te constitutes a part of the contour line of the sole surface 104*a*. The trailing edge Te is the rear edge of the sole surface 104*a*.

The sole surface 104*a* includes a leading surface 130 and a trailing surface 132. The leading surface 130 is formed between the ridgeline 120 and the leading edge Le. The leading surface 130 further extends between the additional surface 122 and the leading edge Le. The additional surface 122 does not reach the leading edge Le. The trailing surface 132 is formed between the ridgeline 120 and the trailing edge Te. The trailing surface 132 further extends between the additional surface 122 and the trailing edge Te. The additional surface 122 does not reach the trailing edge Te.

The leading surface 130 is a convex curved surface. The leading surface 130 is smoothly continuous as a whole. The front edge of the leading surface 130 is the leading edge Le. The rear edge of the leading surface 130 is the ridgeline 120. In a region where the additional surface 122 is present, however, the rear edge of the leading surface 130 is the outer edge line 122*a*.

Figure 5B:
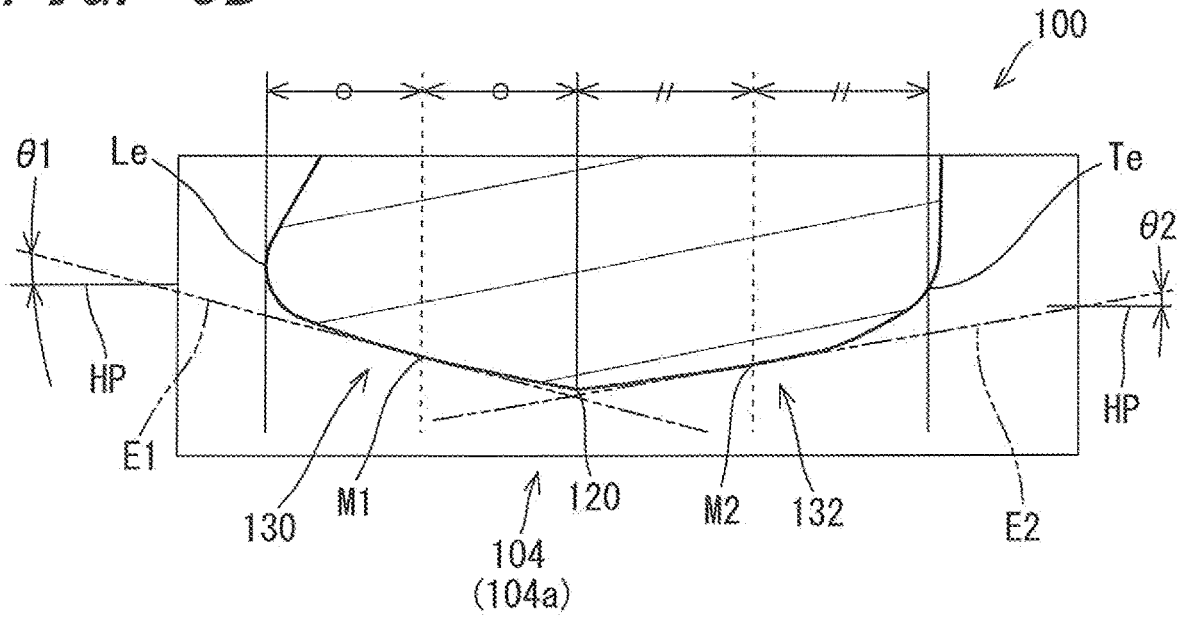
FIG. 5B is a fragmentary enlarged view of a cross section taken along line C-C in FIG. 2.

The leading surface 130 has an inclination angle θ1. As shown in FIG. 5B, the leading surface 130 has a midpoint M1 in a cross section taken in the face-back direction. The midpoint M1 is a point that divides the leading surface 130 into two equal parts in the face-back direction. In the head 100 which is in the reference state, an angle between a tangent line E1 and the ground plane HP is the inclination angle θ1 of the leading surface 130, the tangent line E1 being a line tangent to the leading surface 130 at the midpoint M1. The angle θ1 can vary depending on the cross-sectional position in the toe-heel direction.

The trailing surface 132 is a convex curved surface. The trailing surface 132 is smoothly continuous as a whole. The front edge of the trailing surface 132 is the ridgeline 120. The rear edge of the trailing surface 132 is the trailing edge Te. In a region where the additional surface 122 is present, however, the front edge of the trailing surface 132 is the outer edge line 122*a*.

The trailing surface 132 has an inclination angle θ2. As shown in FIG. 5B, the trailing surface 132 has a midpoint M2 in a cross section taken in the face-back direction. The midpoint M2 is a point that divides the trailing surface 132 into two equal parts in the face-back direction. In the head 100 which is in the reference state, an angle between a tangent line E2 and the ground plane HP is the inclination angle θ2 of the trailing surface 132, the tangent line E2 being a line tangent to the trailing surface 132 at the midpoint M2. The angle θ2 can vary depending on the cross-sectional position in the toe-heel direction.

The inclination angles θ1 and 02 each have a positive or negative value. When the tangent line E1 or E2 is inclined such that it extends upward as it goes frontward, the corresponding inclination angle θ1 or 02 has a positive value. When the tangent line E1 or E2 is inclined such that it extends upward as it goes rearward, the corresponding inclination angle θ1 or 02 has a negative value. In the embodiment of FIG. 5B, the inclination angle θ1 has a positive value and the inclination angle θ2 has a negative value. The inclination angle θ2 can have a positive value.

In the sole surface 104*a* having the ridgeline 120, there is a great difference between the inclination angle θ1 and the inclination angle θ2. The inclination angle θ1 is greater than the inclination angle θ2. The inclination angle θ1 has a positive value. The inclination angle θ1 exhibits an advantageous effect of bounce angle (bounce effect). The leading surface 130 having the inclination angle θ1 prevents the leading edge Le from digging into the ground. For this reason, even when the head path during a swing is deviated, contact between the head and a ball can be stabilized. The inclination angle θ2 is smaller than the inclination angle θ1. The inclination angle θ2 can have a negative value. The trailing surface 132 having the inclination angle θ2 reduces ground resistance and improves smooth pass-through performance. The smooth pass-through performance means the head receives less resistance when the head passes through turf and/or soil. From these viewpoints, in a region that extends from the toe reference position t1 to the heel reference position h1, a difference (θ1−θ2) can be greater than or equal to 5°, further can be greater than or equal to and still further can be greater than or equal to 15°. If this difference of the angles is excessively large, ground resistance at the ridgeline 120 can increase. From this viewpoint, the difference (θ1−θ2) can be less than or equal to further can be less than or equal to 30°, and still further can be less than or equal to 25°. When the angle θ1 has a positive value and the angle θ2 has a negative value, the difference (θ1−θ2) is equal to the sum of the absolute value of θ1 and the absolute value of θ2.

In a region in which the additional surface 122 is present, a virtual sole surface 104*x* and a virtual ridgeline 120*x* can be defined. As shown in FIG. 5A, in a cross section taken in the face-back direction and taken at a position where the additional surface 122 is present, a virtual line F1 obtained by extending the leading surface 130 and a virtual line B1 obtained by extending the trailing surface 132 can be determined. An intersection point P4 between the virtual line F1 and the virtual line B1 is determined. The virtual line F1, the virtual line B1 and the intersection point P4 can be determined in respective cross sections taken at different positions in the toe-heel direction. A set of the virtual lines F1 and the virtual lines B1 is the virtual sole surface 104*x*. A set of the intersection points P4 is the virtual ridgeline 120*x*. Also in the region in which the additional surface 122 is present, the inclination angle θ1 and the inclination angle θ2 can be determined based on the virtual sole surface 104*x*.

Note that the virtual line F1 is determined as follows. In a cross section taken in the face-back direction, a point P5 on the outer edge line 122*a* of the additional surface 122, a point P6 that is spaced 0.5 mm apart from the point P5 toward the face side, and a point P7 that is spaced 0.5 mm apart from the point P6 toward the face side are determined. The virtual line F1 is a part of a circle that passes through the three points P5, P6 and P7. These distances of "0.5 mm" for these points are route lengths measured along the cross-sectional contour line of the sole surface 104*a*. When the points P5, P6 and P7 are positioned on a single straight line, this straight line is determined as the virtual line F1.

Similarly, the virtual line B1 is determined as follows. In a cross section taken in the face-back direction, a point P8 on the outer edge line 122*a* of the additional surface 122, a point P9 that is spaced 0.5 mm apart from the point P8 toward the back side, and a point P10 that is spaced 0.5 mm apart from the point P9 toward the back side are determined. The virtual line B1 is a part of a circle that passes through the three points P8, P9 and P10. These distances of "0.5 mm" for these points are route lengths measured along the cross-sectional contour line of the sole surface 104*a*. When the points P8, P9 and P10 are positioned on a single straight line, this straight line is determined as the virtual line B1.

There is no limitation on the method for forming the additional surface 122. The additional surface 122 is formed simultaneously with the leading surface 130 and the trailing surface 132. Alternatively, the additional surface 122 may be formed by removing a part of the leading surface 130 and a part of the trailing surface 132 after the leading surface 130 and the trailing surface 132 are formed.

Figure 6:
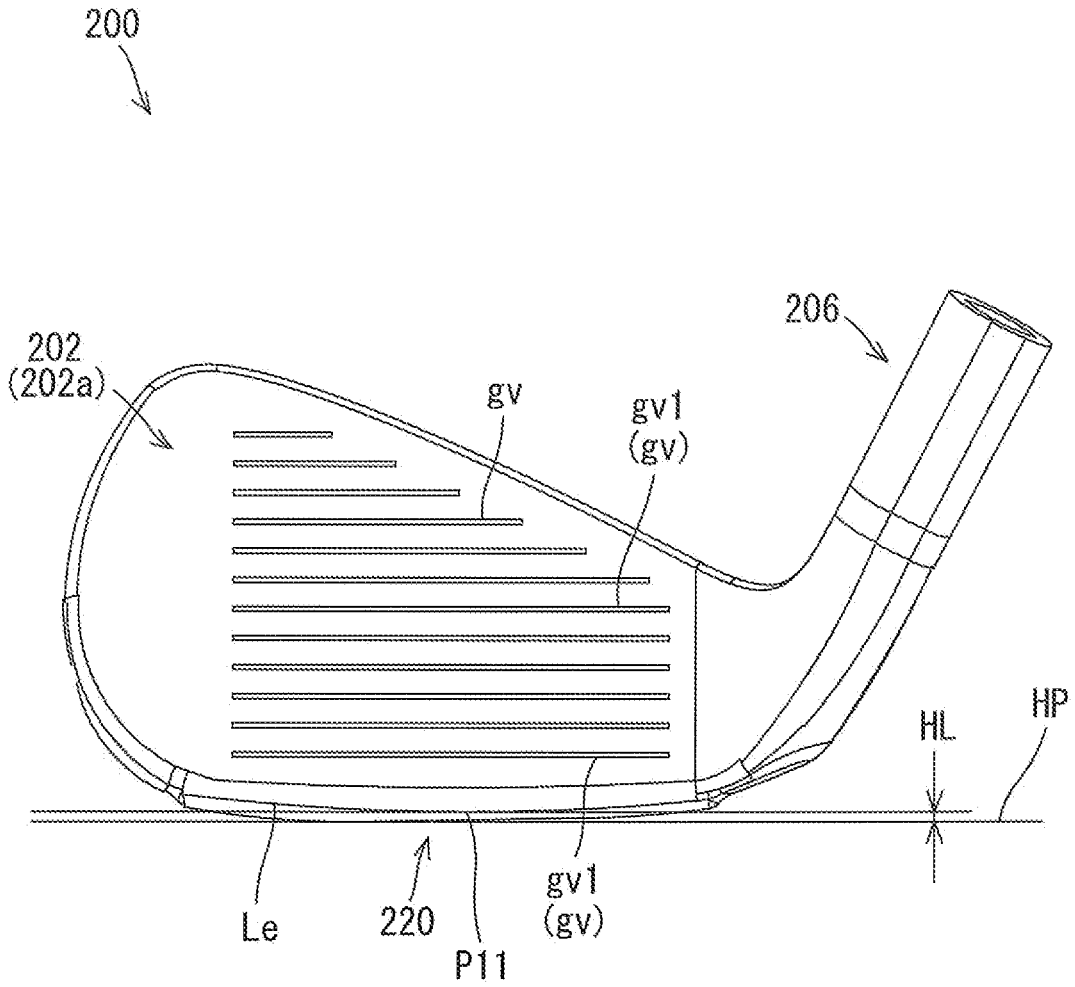
FIG. 6 is a front view of a golf club head according to a second embodiment.
Figure 7:
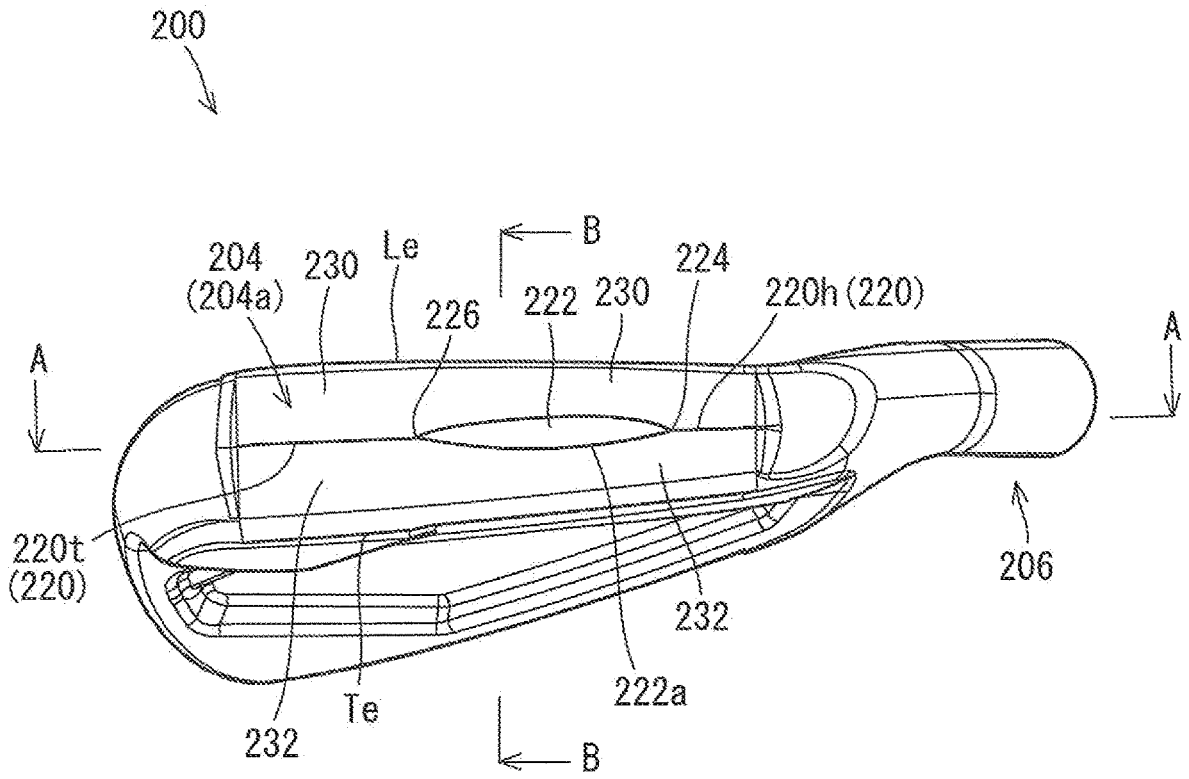
FIG. 7 is a bottom view of the golf club head in FIG. 6.
Figure 8:
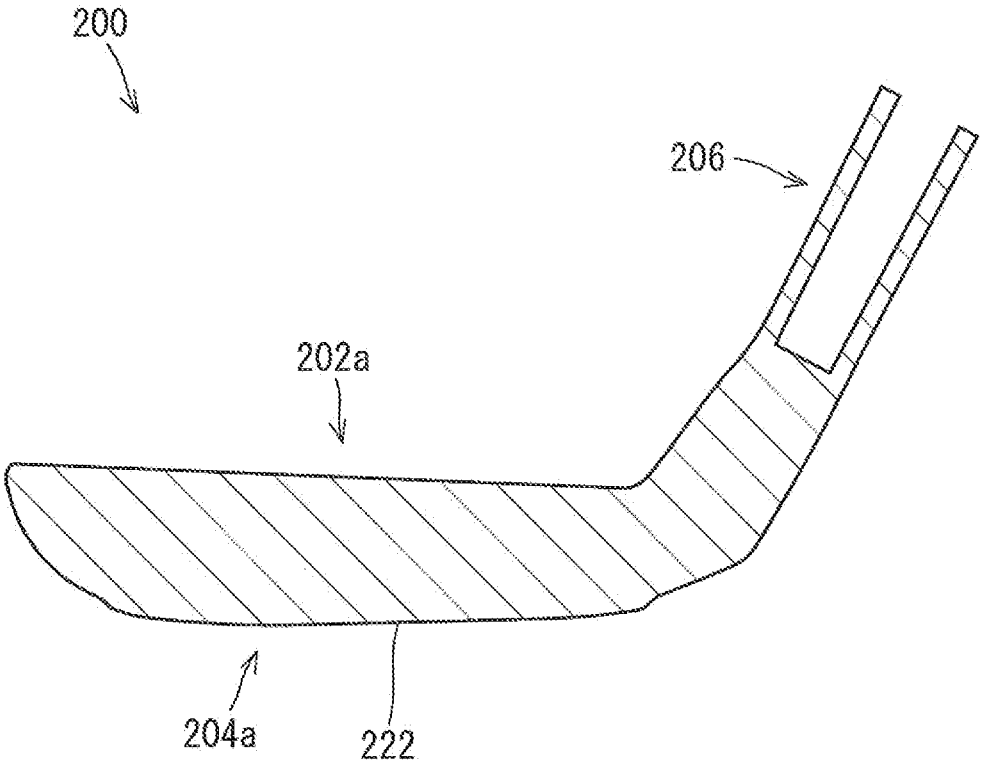
FIG. 8 is a cross-sectional view taken along line A-A in FIG. 7.
Figure 9:
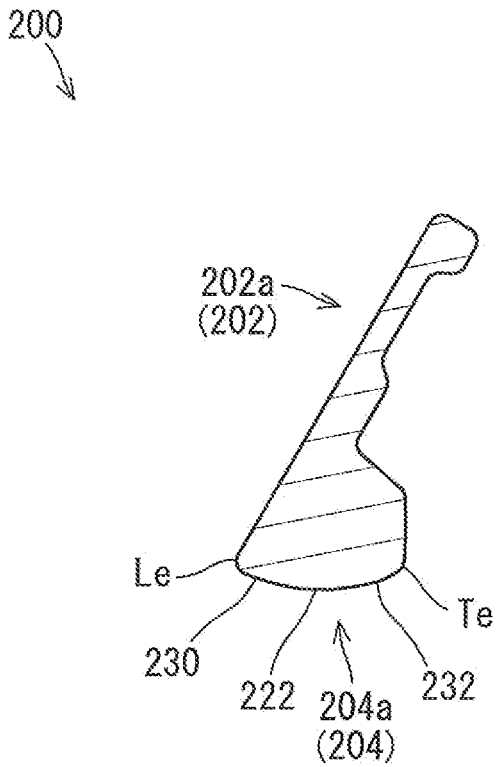
FIG. 9 is a cross-sectional view taken along line B-B in FIG. 7.

FIG. 6 is a front view of a head 200 according to a second embodiment as viewed from the face side. FIG. 7 is a bottom view of the head 200 as viewed from the sole side. FIG. 8 is a cross-sectional view taken along line A-A in FIG. 7. FIG. 9 is a cross-sectional view taken along line B-B in FIG. 7. Note that, in the cross-sectional view of FIG. 9, the score lines gv are omitted.

The head 200 is an iron type golf club head. The head 200 includes a face portion 202, a sole portion 204, and a hosel portion 206.

The face portion 202 includes a hitting face 202*a*. The hitting face 202*a* is a flat surface. A plurality of score lines gv are formed on the hitting face 202*a*. The score lines gv include a longest score line gv1.

As shown in FIG. 7, the sole portion 204 has a sole surface 204*a*. The sole surface 204*a* includes a ridgeline 220 and an additional surface 222. The ridgeline 220 extends from the toe side to the heel side.

In the planar view, the additional surface 222 is a region having an elliptical shape. The additional surface 222 is a flat surface. The additional surface 222 extends to traverse the ridgeline 220. The width of the additional surface 222 in the toe-heel direction is greater than the width of the additional surface 222 in the face-back direction. The additional surface 222 is provided at a position that includes the score line center position c1.

The ridgeline 220 includes a heel ridgeline 220*h* that is located on the heel side with respect to the additional surface 222, and a toe ridgeline 220*t* that is located on the toe side with respect to the additional surface 222. The heel ridgeline 220*h* has a toe-side end point 224. The toe ridgeline 220*t* has a heel-side end point 226. The toe-side end point 224 of the heel ridgeline 220*h* is positioned on an outer edge line 222*a* of the additional surface 222. The heel-side end point 226 of the toe ridgeline 220*t* is positioned on the outer edge line 222*a*.

The head 200 includes a leading edge Le and a trailing edge Te. The leading edge Le constitutes a part of the contour line of the sole surface 204*a*. The trailing edge Te constitutes a part of the contour line of the sole surface 204*a*.

The sole surface 204*a* includes a leading surface 230 and a trailing surface 232. The leading surface 230 is formed between the ridgeline 220 and the leading edge Le. The leading surface 230 further extends between the additional surface 222 and the leading edge Le. The additional surface 222 does not reach the leading edge Le. The trailing surface 232 is formed between the ridgeline 220 and the trailing edge Te. The trailing surface 232 further extends between the additional surface 222 and the trailing edge Te. The additional surface 222 does not reach the trailing edge Te. The leading surface 230 is a convex curved surface. The trailing surface 232 is a convex curved surface.

A double-pointed arrow HL in FIG. 6 is a height (floating height) of the leading edge Le. This height is also referred to as a leading edge height. The height HL is the height of the lowest point of the leading edge Le from the ground plane HP. The height HL is measured when the head is in the reference state. The height HL is measured in the up-down direction. The height HL is reduced by providing the additional surface 222.

The head 100 and the head 200 described above exhibit the following advantageous effects.

As described above, the sole surface having the ridgeline allows the leading surface to exhibit the bounce effect, which stabilizes contact between the head and a ball, and also allows the trailing surface to exhibit an excellent smooth pass-through performance. This configuration having the ridgeline, however, tends to have a higher leading edge height HL. The presence of the additional surface enables the head to have a lower leading edge height HL while keeping the bounce effect. For this reason, the head can hit balls at a higher hitting point on the face surface when hitting balls placed directly on the ground. This enables the head to hit balls at a hitting point closer to the face center, which improves rebound performance.

The additional surface 122 of the first embodiment is a recessed surface, and the additional surface 222 of the second embodiment is a flat surface. The recessed or flat additional surface improves the stability of the head when addressing a golf ball. That is, the recessed surface or the flat surface comes into contact with the ground surface, which stabilizes the posture of the head when addressing a golf ball. This advantageous effect is also referred to as a posture stabilizing effect. From the viewpoint of enhancing the posture stabilizing effect, the additional surface is more preferably a recessed surface.

A virtual leading edge height that is a leading edge height measured when the virtual sole surface 104*x* is formed is denoted by HL1. The height HL1 is also measured when the head is in the reference state. The actual leading edge height HL is lower than the height HL1. The difference (HL1−HL) is a reduced height of the leading edge height HL because of the presence of the additional surface. When the reduced height is excessively large, the additional surface can reach the leading edge Le to encroach on a part of the leading edge Le. From this viewpoint, the reduced height of the leading edge height HL is preferably less than or equal to 2.0 mm, more preferably less than or equal to 1.9 mm, and still more preferably less than or equal to 1.8 mm. From the viewpoint of enlarging the area of the additional surface to enhance the posture stabilizing effect, the reduced height of the leading edge height HL is preferably greater than or equal to 0.5 mm, more preferably greater than or equal to 0.6 mm, and still more preferably greater than or equal to 0.7 mm.

From the viewpoint of positioning hitting points closer to the face center, the leading edge height HL is preferably less than or equal to 5.0 mm, more preferably less than or equal to 4.9 mm, and still more preferably less than or equal to 4.8 mm. From the viewpoint of the bounce effect, the leading edge height HL is preferably greater than or equal to 3.0 mm, more preferably greater than or equal to 3.1 mm, and still more preferably greater than or equal to 3.2 mm.

A two-dot chain line in FIG. 3 shows a straight line L1 that passes through two points on the outer edge line 122*a* of the additional surface 122. The straight line L1 is a straight line on a specific cross section (cross section taken along line A-A in FIG. 2) taken in the toe-heel direction. The position of the specific cross section in the face-back direction is determined in a center cross section (FIG. 4) that is taken at the score line center position c1 and taken in the face-back direction. That is, the specific cross section passes through a midpoint M3 (see FIG. 5A) of the additional surface 122 in the center cross section.

The midpoint M3 is a point that divides the additional surface 122 into two equal parts in the face-back direction. A double-pointed arrow θ3 in FIG. 3 shows an angle between the straight line L1 and the ground plane HP in the head 100 which is in the reference state. The angle θ3 is an angle in the toe-heel direction between the additional surface 122 and the ground plane HP when the head 100 is in the reference state.

From the viewpoint of the posture stabilizing effect, the absolute value of the angle θ3 is preferably less than or equal to 10°, more preferably less than or equal to 8°, and still more preferably less than or equal to 6°. The absolute value of the angle θ3 may be 0°.

A two-dot chain line in FIG. 5 shows a straight line L2 that passes through two points on the outer edge line 122*a* of the additional surface 122. The straight line L2 is a straight line drawn on the center cross section. A double-pointed arrow θ4 in FIG. 5A is an angle between the straight line L2 and the ground plane HP in the head 100 which is in the reference state. This angle θ4 is an angle in the face-back direction between the additional surface 122 and the ground plane HP when the head 100 is in the reference state.

From the viewpoint of the posture stabilizing effect, the absolute value of the angle θ4 is preferably less than or equal to 10°, more preferably less than or equal to 9°, and still more preferably less than or equal to 8°. The absolute value of the angle θ4 may be 0°.

Figure 10A:
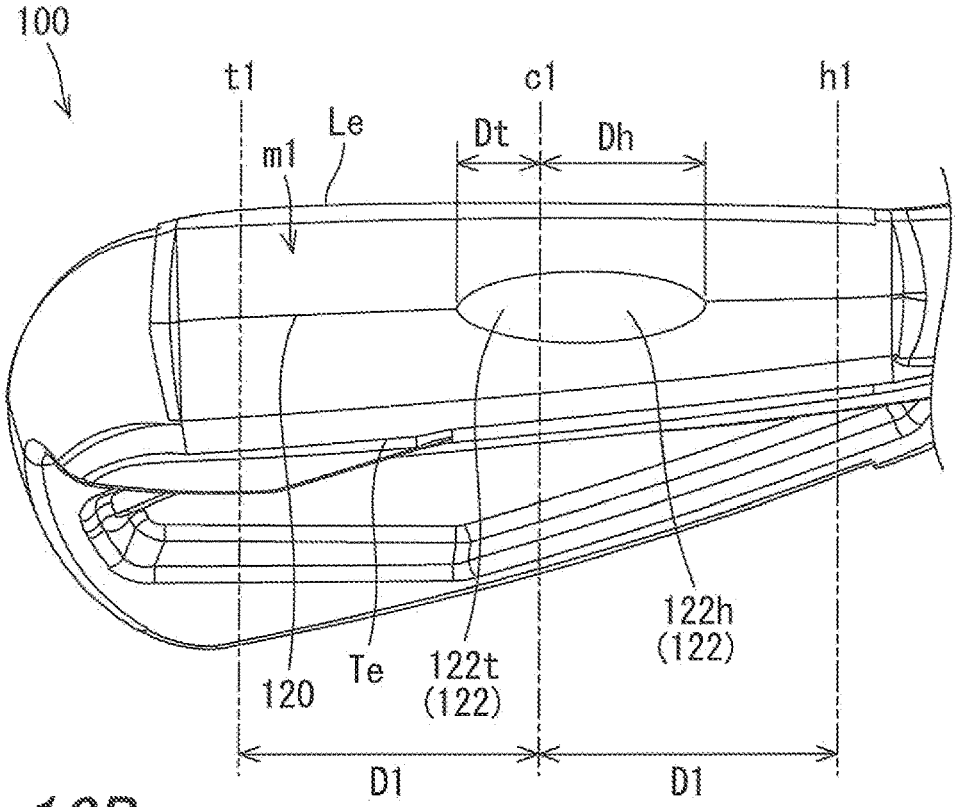
FIG. 10A is a fragmentary enlarged view of FIG. 2.

FIG. 10A is a fragmentary enlarged view of FIG. 2. The additional surface 122 of the head 100 includes a toe part 122*t* located on the toe side with respect to the score line center position c1, and a heel part 122*h* located on the heel side with respect to the score line center position c1. A length Dh of the heel part 122*h* in the toe-heel direction is longer than a length Dt of the toe part 122*t* in the toe-heel direction.

Figure 10B:
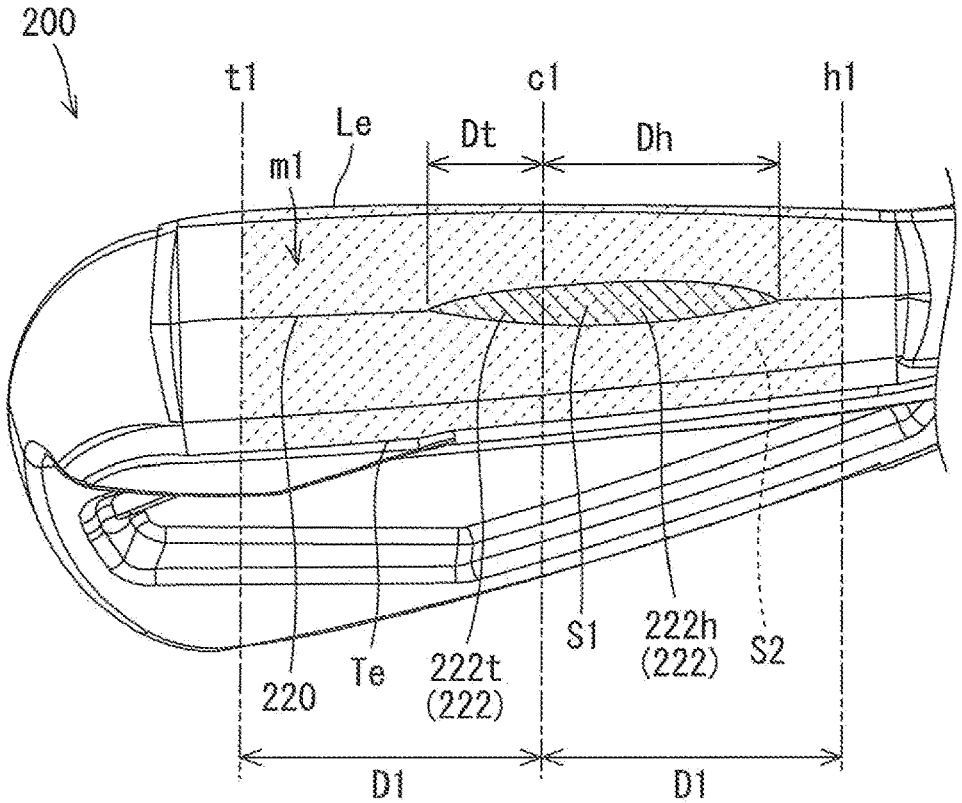
FIG. 10B is a fragmentary enlarged view of FIG. 7.

FIG. 10B is a fragmentary enlarged view of FIG. 7. The additional surface 222 of the head 200 includes a toe part 222*t* located on the toe side with respect to the score line center position c1, and a heel part 222*h* located on the heel side with respect to the score line center position c1. A length Dh of the heel part 222*h* in the toe-heel direction is longer than a length Dt of the toe part 222*t* in the toe-heel direction.

In both the embodiments, the length Dh is longer than the length Dt. In other words, a ratio (Dh/Dt) is greater than 1. The inventor of the present disclosure has found that, when actually addressing a golf ball with a head, a toe side part of the head is floating off from the ground surface, and a heel side part of the sole surface comes into contact with the ground surface. When Dh is greater than Dt, the advantageous effects brought by the additional surface are enhanced. From this viewpoint, the ratio (Dh/Dt) is preferably greater than or equal to 1.7, more preferably greater than or equal to 1.8, and still more preferably greater than or equal to 1.9. An excessively great (Dh/Dt) reduces the advantageous effects brought by the additional surface. The ratio (Dh/Dt) is preferably less than or equal to 2.3, more preferably less than or equal to 2.2, and still more preferably less than or equal to 2.1.

Double-pointed arrows D1 in FIG. 10A and FIG. 10B show a distance in the toe-heel direction between the score line center position c1 and the heel reference position h1. The distance D1 is also a distance in the toe-heel direction between the score line center position c1 and the toe reference position t1. As described above, the position and scope of the additional surface are preferably set while considering an actual address. The following ranges are preferable from this viewpoint. A ratio (Dh/D1) is preferably greater than or equal to 0.40, more preferably greater than or equal to 0.45, and still more preferably greater than or equal to 0.50. The ratio (Dh/D1) is preferably less than or equal to 0.90, more preferably less than or equal to 0.85, and still more preferably less than or equal to 0.80. A ratio (Dt/D1) is preferably greater than or equal to 0.15, more preferably greater than or equal to 0.20, and still more preferably greater than or equal to 0.25. The ratio (Dt/D1) is preferably less than or equal to 0.50, more preferably less than or equal to 0.45, and still more preferably less than or equal to 0.40.

In the planar view, each of areas of the additional surfaces 122 and 222 is denoted by S1. An area indicated with solid-line hatching in FIG. 10B is the area S1. The area of a sole main part m1 in the planar view is denoted by S2. Of the sole surface, a part located between the heel reference position h1 and the toe reference position t1 is the sole main part m1. An area indicated with dushed-line hatching in FIG. 10B is the area S2.

From the viewpoint of enhancing the advantageous effects brought by the additional surface, a ratio (S1/S2) is preferably greater than or equal to 0.03, more preferably greater than or equal to 0.04, and still more preferably greater than or equal to 0.05. An excessively large additional surface can reduce the advantageous effects brought by the leading surface and the trailing surface. From this viewpoint, the ratio (S1/S2) is preferably less than or equal to 0.30, more preferably less than or equal to 0.20, and still more preferably less than or equal to 0.15.

The additional surface may be subjected to surface treatment that makes the appearance of the additional surface different from that of the remaining portion of the sole surface. Such a surface treatment makes it easy to see the contour of the additional surface. For example, the additional surface may be subjected to a shot-blasting treatment. In this case, the remaining portion of the sole surface is subjected to a treatment that makes the appearance of the remaining portion different from the appearance of the additional surface subjected to the shot-blasting treatment. Examples of such a treatment include mirror polishing and satin finishing.

Figure 11:
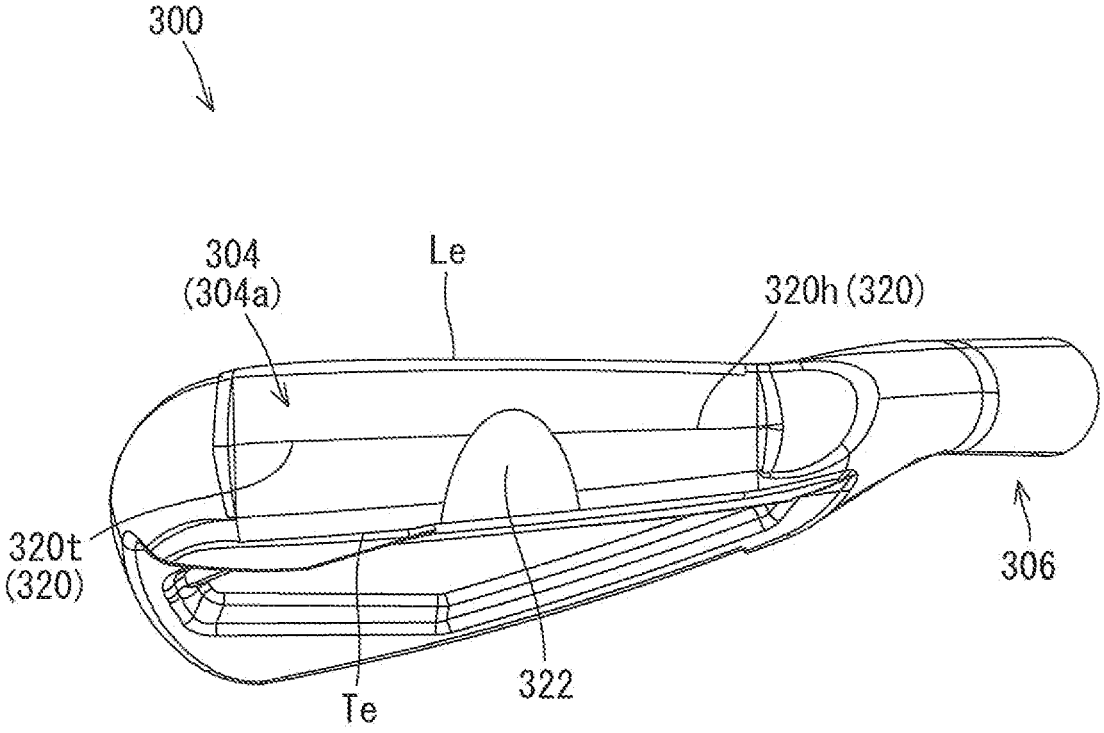
FIG. 11 is a bottom view of a golf club head according to a third embodiment.

FIG. 11 shows a bottom view of a head 300 according to a third embodiment. The head 300 includes a sole portion 304 and a hosel portion 306. The sole portion 304 has a sole surface 304*a*. The sole surface 304*a* includes a ridgeline 320 and an additional surface 322. The ridgeline 320 includes a toe ridgeline 320*t* that is located on the toe side with respect to the additional surface 322 and a heel ridgeline 320*h* that is located on the heel side with respect to the additional surface 322. The head 300 is the same as the head 100 except for the shape of the additional surface 322. In the head 300, the additional surface 322 extends to reach the trailing edge Te. This head 300 can further reduce ground resistance.

There is no limitation on the club number and loft angle (real loft angle) of the head. The present disclosure is applicable to all kinds of iron type heads, such as long irons, middle irons, short irons and wedges. Stabilization of contact between the head and a ball, improvement in smooth pass-through performance, improvement in position of hitting points, and the posture stabilizing effect are more effectively exhibited when performing a full-swing shots with great head speed. From this viewpoint, long irons, middle irons and short irons are preferable, and long irons and middle irons are more preferable. The loft angle is preferably greater than or equal to 20 degrees and less than 60 degrees, more preferably greater than or equal to 20 degrees and less than or equal to 50 degrees, still more preferably greater than or equal to 20 degrees and less than or equal to 40 degrees, and yet more preferably greater than or equal to 20 degrees and less than or equal to 35 degrees.

The following clauses are a part of invention included in the present disclosure.

[Clause 1]

An iron type golf club head including:

a hitting face including a plurality of score lines;

a sole surface;

a leading edge that constitutes a front edge of the sole surface;

a trailing edge that constitutes a rear edge of the sole surface; and a score line center position that is determined based on the score lines, wherein the sole surface includes a ridgeline that extends from a toe side to a heel side, and an additional surface that is a flat surface or a recessed surface and extends to traverse the ridgeline.

[Clause 2]

The golf club head according to clause 1, wherein the additional surface is the recessed surface.

[Clause 3]

The golf club head according to clause 1 or 2, wherein the additional surface includes a toe part that is located on the toe side with respect to the score line center position, and a heel part that is located on the heel side with respect to the score line center position, and a length of the heel part in a toe-heel direction is longer than a length of the toe part in the toe-heel direction.

[Clause 4]

The golf club head according to any one of clauses 1 to 3, wherein when a height of a lowest point of the leading edge from a ground plane is referred to as a leading edge height, the leading edge height being measured when the golf club head is in a reference state, a reduced height of the leading edge height because of the presence of the additional surface is greater than or equal to 0.5 mm and less than or equal to 2.0 mm.

LIST OF REFERENCE SYMBOLS

100, 200, 300 Golf club head
102, 202 Face portion
102*a*, 202*a* Hitting face (face surface)
104, 204, 304 Sole portion
104*a*, 204*a*, 304*a* Sole surface
120, 220, 320 Ridgeline
122, 222, 322 Additional surface
122*t*, 222*t* Toe part of the additional surface
122*h*, 222*h* Heel part of the additional surface
gv Score line
gv1 Longest score line HL Leading edge height Le Leading edge Te Trailing edge The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. An iron type golf club head comprising:

a hitting face including a plurality of score lines;

a sole surface;

a leading edge that constitutes a front edge of the sole surface;

a trailing edge that constitutes a rear edge of the sole surface; and a score line center position that is determined based on the score lines, wherein the sole surface includes a ridgeline that extends from a toe side to a heel side, and an additional surface that is a flat surface or a recessed surface and extends to traverse the ridgeline, the ridgeline has a gap in a region in which the additional surface is present, the ridgeline is constituted by a heel ridgeline that is located on the heel side with respect to the additional surface, and a toe ridgeline that is located on the toe side with respect to the additional surface, a line segment that connects a toe-side end point of the heel ridgeline and a heel-side end point of the toe ridgeline intersects the additional surface in a planar view, a position of a heel-most end among heel-side ends of the score lines is defined as a heel reference position, a position that is spaced 18 mm apart from a toe-most point of the golf club head toward the heel side is defined as a toe reference position, the score line center position is a position that divides a distance between the heel reference position and the toe reference position into two equal parts, and when a height of a lowest point of the leading edge from a ground plane is referred to as a leading edge height, the leading edge height being measured when the golf club head is in a reference state, a reduced height of the leading edge height because of the presence of the additional surface is greater than or equal to 0.5 mm and less than or equal to 2.0 mm.

2. The golf club head according to claim 1, wherein the additional surface is the recessed surface.

3. The golf club head according to claim 1, wherein the additional surface includes a toe part that is located on the toe side with respect to the score line center position, and a heel part that is located on the heel side with respect to the score line center position, and a length of the heel part in a toe-heel direction is longer than a length of the toe part in the toe-heel direction.

4. An iron type golf club head comprising:

a hitting face including a plurality of score lines;

a sole surface;

a leading edge that constitutes a front edge of the sole surface;

a trailing edge that constitutes a rear edge of the sole surface; and a score line center position that is determined based on the score lines, wherein the sole surface includes a ridgeline that extends from a toe side to a heel side, and an additional surface that is a flat surface or a recessed surface and extends to traverse the ridgeline, the additional surface is located apart from the leading edge, the additional surface is located apart from the trailing edge, the ridgeline has a gap in a region in which the additional surface is present, the ridgeline is constituted by a heel ridgeline that is located on the heel side with respect to the additional surface, and a toe ridgeline that is located on the toe side with respect to the additional surface, a line segment that connects a toe-side end point of the heel ridgeline and a heel-side end point of the toe ridgeline intersects the additional surface in a planar view, a position of a heel-most end among heel-side ends of the score lines is defined as a heel reference position, a position that is spaced 18 mm apart from a toe-most point of the golf club head toward the heel side is defined as a toe reference position, the score line center position is a position that divides a distance between the heel reference position and the toe reference position into two equal parts, a position of a heel-most end among heel-side ends of the score lines is defined as a heel reference position, a position that is spaced 18 mm apart from a toe-most point of the golf club head toward the heel side is defined as a toe reference position, of the sole surface, a part located between the heel reference position and the toe reference position is defined as a sole main part, an area of the sole main part in a planar view is denoted by S2, an area of the additional surface in the planar view is denoted by S1, and S1/S2 is greater than or equal to 0.03 and less than or equal to 0.30.

5. The golf club head according to claim 4, wherein the additional surface includes a toe part that is located on the toe side with respect to the score line center position, and a heel part that is located on the heel side with respect to the score line center position, and a length of the heel part in a toe-heel direction is longer than a length of the toe part in the toe-heel direction.

6. The golf club head according to claim 4, wherein when a height of a lowest point of the leading edge from a ground plane is referred to as a leading edge height, the leading edge height being measured when the golf club head is in a reference state, a reduced height of the leading edge height because of the presence of the additional surface is greater than or equal to 0.5 mm and less than or equal to 2.0 mm.

7. The golf club head according to claim 4, wherein the additional surface includes a toe part that is located on the toe side with respect to the score line center position, and a heel part that is located on the heel side with respect to the score line center position, and when a length of the heel part in a toe-heel direction is denoted by Dh, and a length of the toe part in the toe-heel direction is denoted by Dt, then Dh/Dt is greater than or equal to 1.7 and less than or equal to 2.3.

8. The golf club head according to claim 4, wherein the additional surface includes a heel part that is located on the heel side with respect to the score line center position, a length of the heel part in a toe-heel direction is denoted by Dh, a position of a heel-most end among heel-side ends of the score lines is defined as a heel reference position, a distance in the toe-heel direction between the score line center position and the heel reference position is denoted by D1, and Dh/D1 is greater than or equal to 0.40 and less than or equal to 0.90.

9. An iron type golf club head comprising:

a hitting face including a plurality of score lines;

a sole surface;

a leading edge that constitutes a front edge of the sole surface;

a trailing edge that constitutes a rear edge of the sole surface; and a score line center position that is determined based on the score lines, wherein the sole surface includes a ridgeline that extends from a toe side to a heel side, and an additional surface that is a flat surface or a recessed surface and extends to traverse the ridgeline, the additional surface is located apart from the leading edge, the additional surface extends to reach the trailing edge, the ridgeline has a gap in a region in which the additional surface is present, the ridgeline is constituted by a heel ridgeline that is located on the heel side with respect to the additional surface, and a toe ridgeline that is located on the toe side with respect to the additional surface, a line segment that connects a toe-side end point of the heel ridgeline and a heel-side end point of the toe ridgeline intersects the additional surface in a planar view, a position of a heel-most end among heel-side ends of the score lines is defined as a heel reference position, a position that is spaced 18 mm apart from a toe-most point of the golf club head toward the heel side is defined as a toe reference position, the score line center position is a position that divides a distance between the heel reference position and the toe reference position into two equal parts, the additional surface includes a toe part that is located on the toe side with respect to the score line center position, and a heel part that is located on the heel side with respect to the score line center position, and a length of the heel part in a toe-heel direction is longer than a length of the toe part in the toe-heel direction.

10. The golf club head according to claim 9, wherein the additional surface is the recessed surface.

11. The golf club head according to claim 9, wherein when a height of a lowest point of the leading edge from a ground plane is referred to as a leading edge height, the leading edge height being measured when the golf club head is in a reference state, a reduced height of the leading edge height because of the presence of the additional surface is greater than or equal to 0.5 mm and less than or equal to 2.0 mm.

12. The golf club head according to claim 9, wherein the additional surface includes a toe part that is located on the toe side with respect to the score line center position, and a heel part that is located on the heel side with respect to the score line center position, and when a length of the heel part in a toe-heel direction is denoted by Dh, and a length of the toe part in the toe-heel direction is denoted by Dt, then Dh/Dt is greater than or equal to 1.7 and less than or equal to 2.3.

13. The golf club head according to claim 9, wherein the additional surface includes a heel part that is located on the heel side with respect to the score line center position, a length of the heel part in a toe-heel direction is denoted by Dh, a position of a heel-most end among heel-side ends of the score lines is defined as a heel reference position, a distance in the toe-heel direction between the score line center position and the heel reference position is denoted by D1, and Dh/D1 is greater than or equal to 0.40 and less than or equal to 0.90.

14. The golf club head according to claim 9, wherein a position of a heel-most end among heel-side ends of the score lines is defined as a heel reference position, a position that is spaced 18 mm apart from a toe-most point of the golf club head toward the heel side is defined as a toe reference position, of the sole surface, a part located between the heel reference position and the toe reference position is defined as a sole main part, an area of the sole main part in a planar view is denoted by S2, an area of the additional surface in the planar view is denoted by S1, and S1/S2 is greater than or equal to 0.03 and less than or equal to 0.30.

15. The golf club head according to claim 1, wherein an entirety of the additional surface is positioned between the heel reference position and the toe reference position.

* * * * *